US006976412B1

(12) United States Patent
Yu

(10) Patent No.: US 6,976,412 B1
(45) Date of Patent: Dec. 20, 2005

(54) TOOL EQUIPPED WITH A TURNABLE DRIVING HEAD

(76) Inventor: Min-Chi Yu, No.5, Zhengde Lane 3, Sec. 2, Daqing St., South District, Taichung City (TW)

( * ) Notice: Subject to any disclaimer, the term of this patent is extended or adjusted under 35 U.S.C. 154(b) by 0 days.

(21) Appl. No.: 10/856,784

(22) Filed: Jun. 1, 2004

(51) Int. Cl.[7] ..... B25B 7/12
(52) U.S. Cl. ..... 81/302; 81/485; 29/229
(58) Field of Search ..... 81/302, 485, 486; 29/229

(56) References Cited

U.S. PATENT DOCUMENTS 1,514,488 A * 11/1924 Wernimont ..... 7/130
2,325,035 A * 7/1943 Cargile ..... 81/387
3,040,420 A * 6/1962 Kulp ..... 29/229
3,762,019 A * 10/1973 Epstein ..... 29/229
5,327,802 A * 7/1994 Yu ..... 81/312
5,483,732 A * 1/1996 Wang ..... 29/229
5,515,587 A * 5/1996 Pool ..... 29/229
5,826,467 A * 10/1998 Huang ..... 81/302
6,134,993 A * 10/2000 Tally ..... 81/394
6,470,774 B2 * 10/2002 Chang ..... 81/302
6,792,837 B2 * 9/2004 Battistone ..... 81/302

* cited by examiner

*Primary Examiner*—David B. Thomas
(74) *Attorney, Agent, or Firm*—Birch, Stewart, Kolasch & Birch, LLP

(57) ABSTRACT

A tool equipped with a turnable driving head includes a left handle and a right handle to couple with a right driving section and a left driving section therebetween. The left handle and the right handle and the right and the left driving sections are coupled together by a coupling element such that the right and left driving sections may be anchored on the front sides of the left and the right handles at a selected angle to wrench C-shaped snap rings to facilitate operation.

5 Claims, 9 Drawing Sheets

TOOL EQUIPPED WITH A TURNABLE DRIVING HEAD

FIELD OF THE INVENTION

The present invention relates to a hand tool for wrenching C-shaped snap rings and particularly to hand tool equipped with a turnable driving head which has an alterable angle to facilitate wrenching operation.

BACKGROUND OF THE INVENTION

Conventional hand tools for assembling or disassembling C-shaped snap rings such as the one shown in FIG. 1, or long-nose pliers for clamping and extending articles, generally have two insert pins 1 on the front end to couple with two round holes of the C-shaped snap ring (not shown in the drawing) so that the C-shaped snap ring may be removed from the latch groove of a shaft by maneuvering the handles of the pliers. The two insert pins 1 and the handles generally are aligned on the same straight lines. In some complicated machinery the C-shaped snap rings are coupled with the shafts on locations where to couple the insert pins with the round holes of the C-shaped snap rings is difficult. As the driving heads of the pliers cannot be turned to adjust the angle of the insert pins, operation often is hindered due to space constraint.

SUMMARY OF THE INVENTION

Therefore the primary object of the invention is to provide a tool equipped with a turnable driving head that includes a left handle and a right handle. The front ends of the left and right handles are pivotally coupled with a left driving section and a right driving section to clamp work pieces. The left and right driving sections are turnable angularly to be anchored on the front ends of the left and right handles to facilitate assembly and disassembly and wrenching of C-shaped snap rings.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
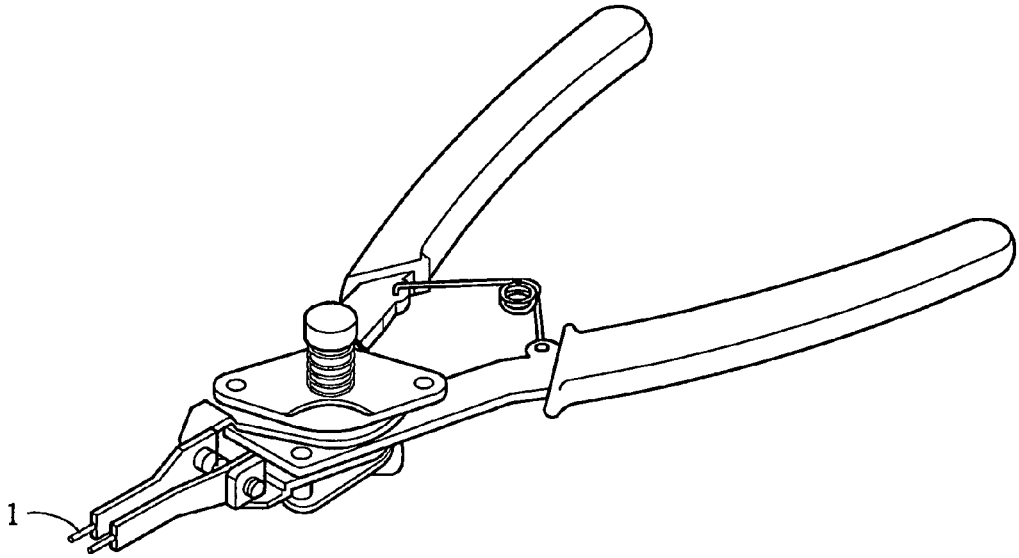
PRIOR ART Fig . 1
FIG. 1 is a perspective view of a conventional hand tool for assembling and disassembling C-shaped snap rings.
Figure 2:
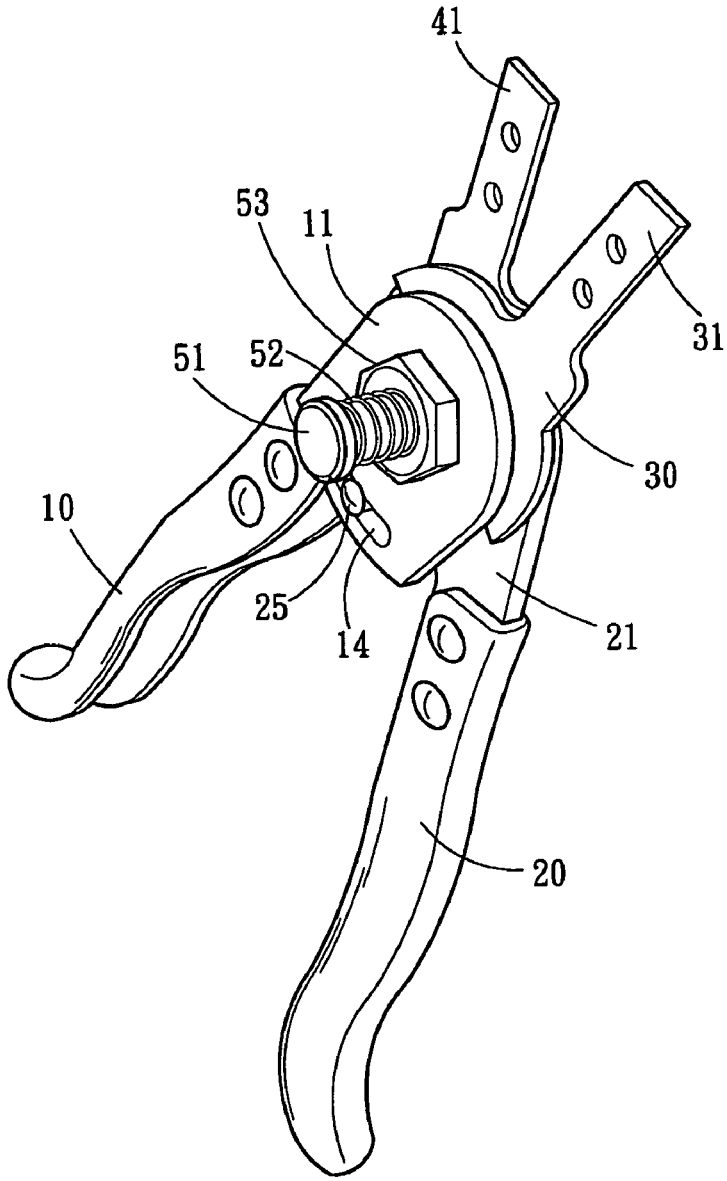
FIG. 2 is a perspective view of the present invention.
Figure 3:
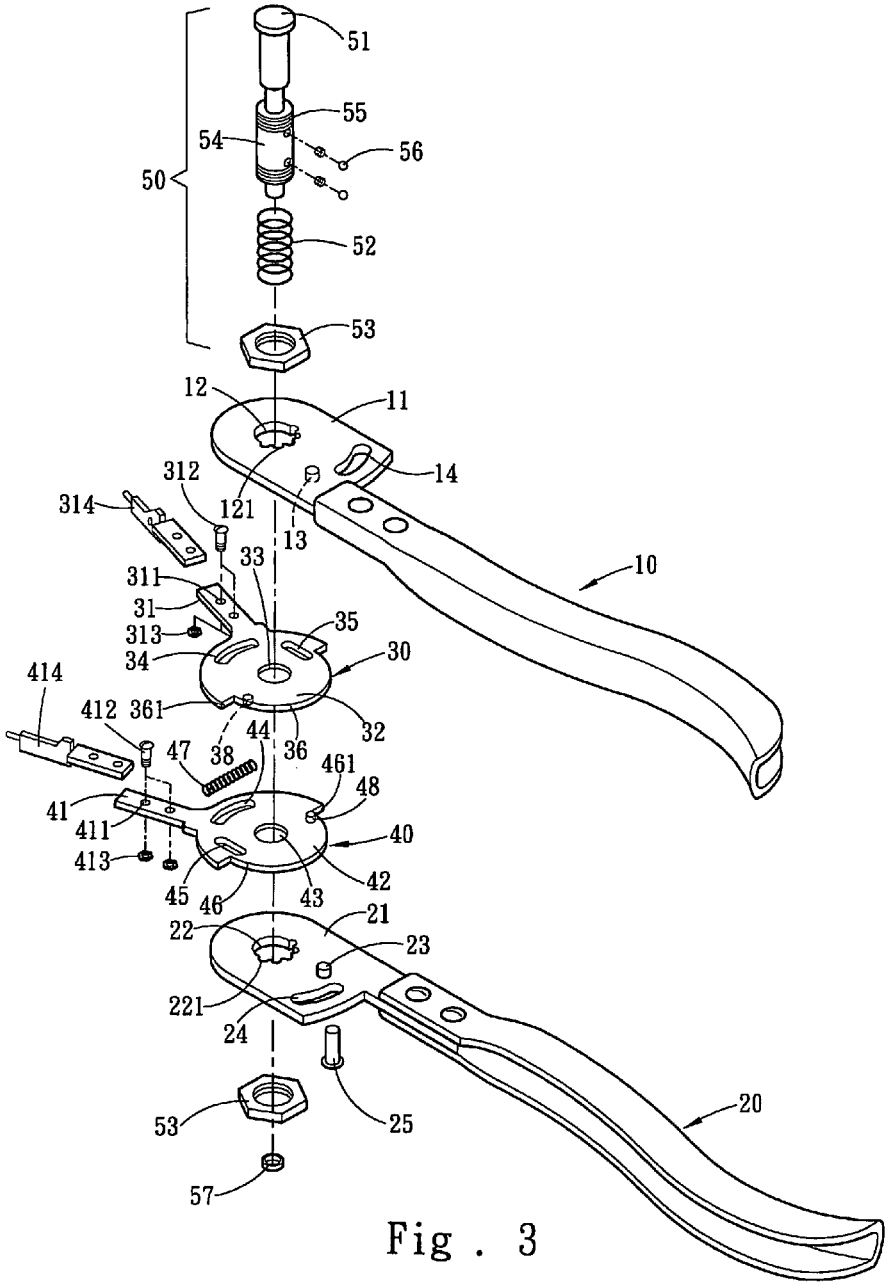
FIG. 3 is an exploded view of the present invention.
Figure 4A:
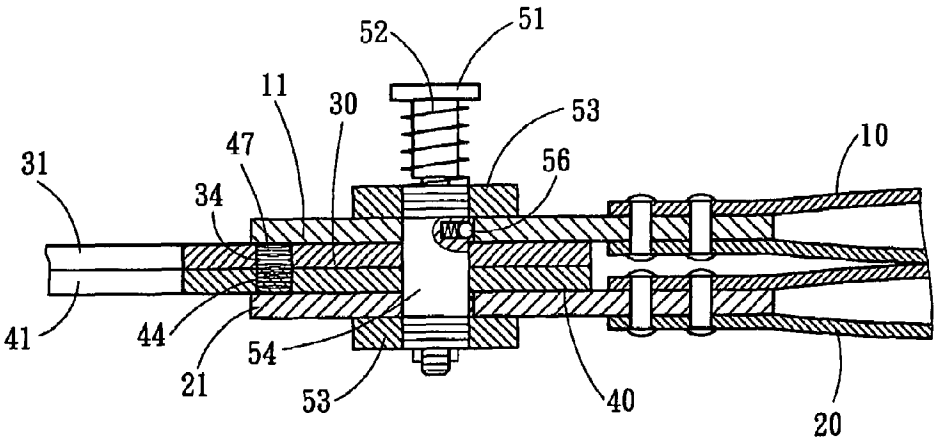
FIG. 4A is a fragmentary sectional view of the invention.

Please referring to FIGS. 2 and 3, the tool equipped with a turnable driving head according to the invention includes:

a left handle 10 which has a rear end to be grasped by user's hands for wrenching and a first plate 11 on a front end. The first plate 11 has a longitudinal first bore 12 which has four first anchor notches 121 on the inner rim spaced from one another at a selected interval. The first plate 11 also has a first anchor strut 13 below the first bore 12 and located on the left side of the center line of the first plate 11. The first plate 11 further has an arched first retaining trough 14 on the right side of the center line of the first plate 11;

a right handle 20 pivotally coupled with the left handle 10 in an opposing manner. It has a rear end to be grasped by user's hands for wrenching and a second plate 21 on a front end. The second plate 21 has a longitudinal second bore 22 which has four second anchor notches 221 on the inner rim. The second plate 21 also has a second anchor strut 23 located on the right side of the center line of the second plate 21. The second plate 21 further has an arched second retaining trough 24 on the left side of the second plate 11 corresponding to the first retaining trough 14 of the first plate 11 in a up and down manner to receive a pin 25 for coupling the two together;

a right driving section 30 located below the left handle 10 having a first coupling end 31 on a front side and a round first pivot end 32 on a rear side. The first pivot end 32 has a first pivot hole 33 in the center, an arched first housing trough 34 on a front and left diagonal corner and an arched first slot 35 on the upper right side thereof. The first pivot end 32 further has a concave first swivel rim 36 on the rear side retracted towards the center and two first bucking sections 361 on two sides thereof. The first coupling end 31 has two first apertures 311 formed in a front and rear manner to receive first bolts 312 to couple with first nuts 313 to fasten a right jaw 314;

a left driving section 40 corresponding to the right driving section 30 in a up and down manner and having a plate type second coupling end 41 on a front side and a round second pivot end 42 on a rear side. The second pivot end 42 has a second pivot hole 43 in the center, an arched second housing trough 44 on a right and front diagonal corner and an arched second slot 45 on the upper left side thereof. The second pivot end 42 further has a concave second swivel rim 46 on the rear side retracted towards the center and two second bucking sections 461 on two sides thereof. The second housing trough 44 and the first housing trough 34 are coupled to hold an elastic element 47 (spring) which has one end pressing the second housing trough 44 and other end pressing the first housing trough 34 to keep the right driving section 30 and the left driving section 40 to extend constantly. The right driving section 30 and the left driving section 40 further have respectively a first stub 38 and a second stub 48 to couple with the second slot 45 and first slot 35. The second coupling end 41 of the left driving section 40 has two second apertures 411 to receive second bolts 412 to coupled with second nuts 413 to fasten a left jaw 414; and a coupling element 50 (referring to FIG. 4A) functioning like a pin. It has a bolt head 51 on one end, and may run through a spring 52 and a third nut 53 and the first bore 12 of the left handle 10, the first pivot hole 33 of the right driving section 30, the second pivot hole 43 of the left driving section 40, and the second bore 22 of the right handle 20. It also has an actuating shaft 54 on other one end matching the sizes of the second and first pivot holes 43 and 33. The actuating shaft 54 has a screw thread section 55 located respectively on a upper end and a lower end, and an elastic anchor member 56 such as a steel ball pressing by a spring abutting each screw thread section 55 corresponding to the first anchor notches 121 of the left handle 10 and the second anchor notches 221 of the right handle 20. The actuating shaft 54 has a distal end coupled with the third nut 53 and confined by a retaining ring 57 thereby to pivotally couple the left and right handles 10 and 20, and the left and right driving sections 40 and 30 together.

Users may select a left jaw 414 and a right jaw 314 of a desired size for fastening to the left and right driving sections 40 and 30 according to the specification of the C-shaped snap ring.

Figure 4B:
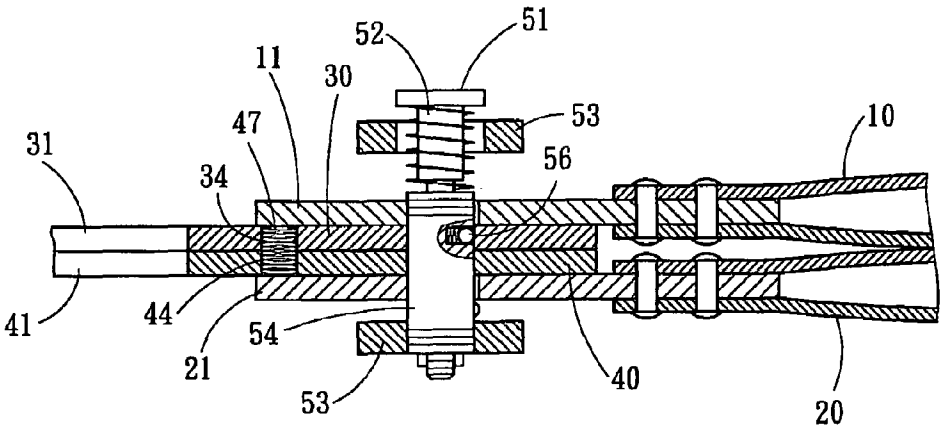
FIG. 4B is a fragmentary sectional view of the invention in an operating condition according to FIG. 4A.
Figure 5A:
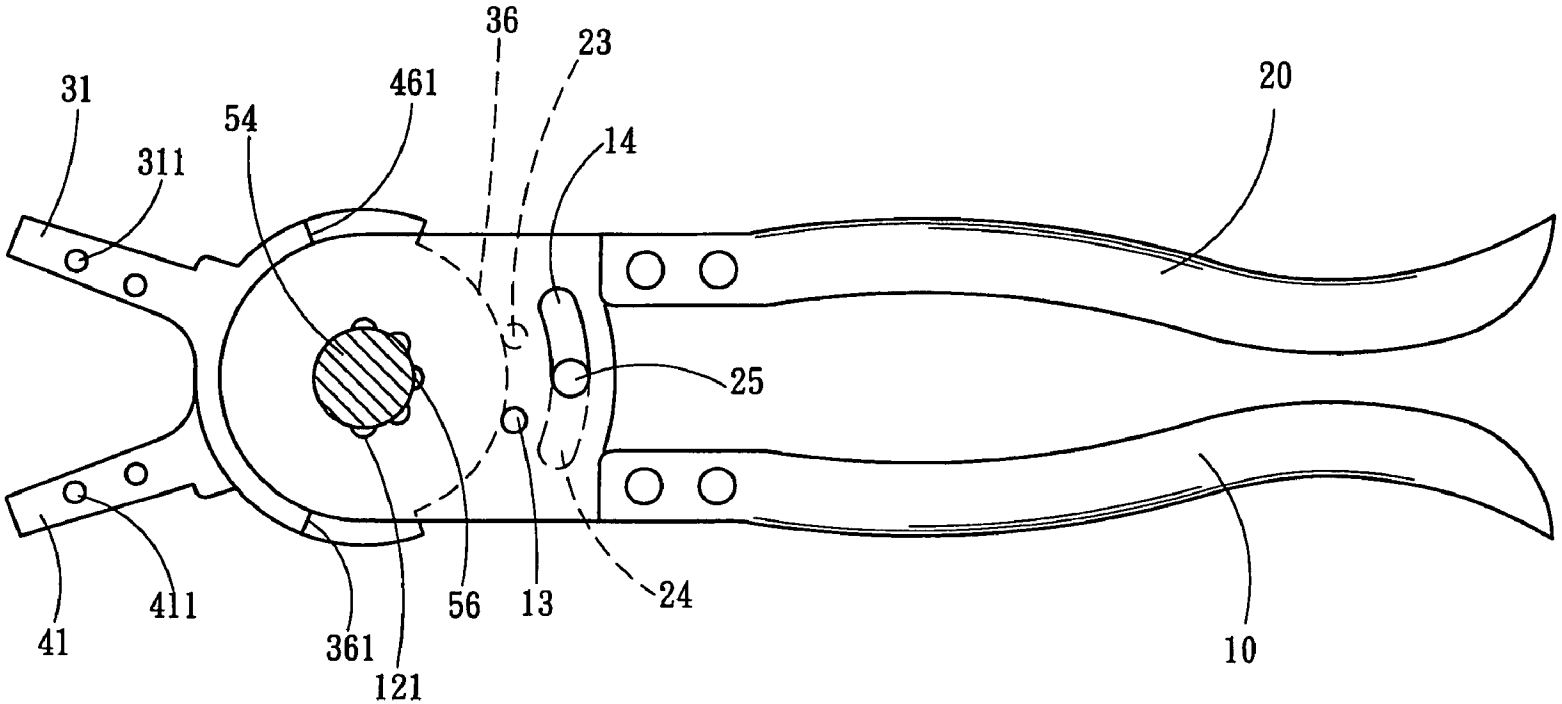
FIG. 5A is a plain view of an embodiment of the invention.
Figure 5B:
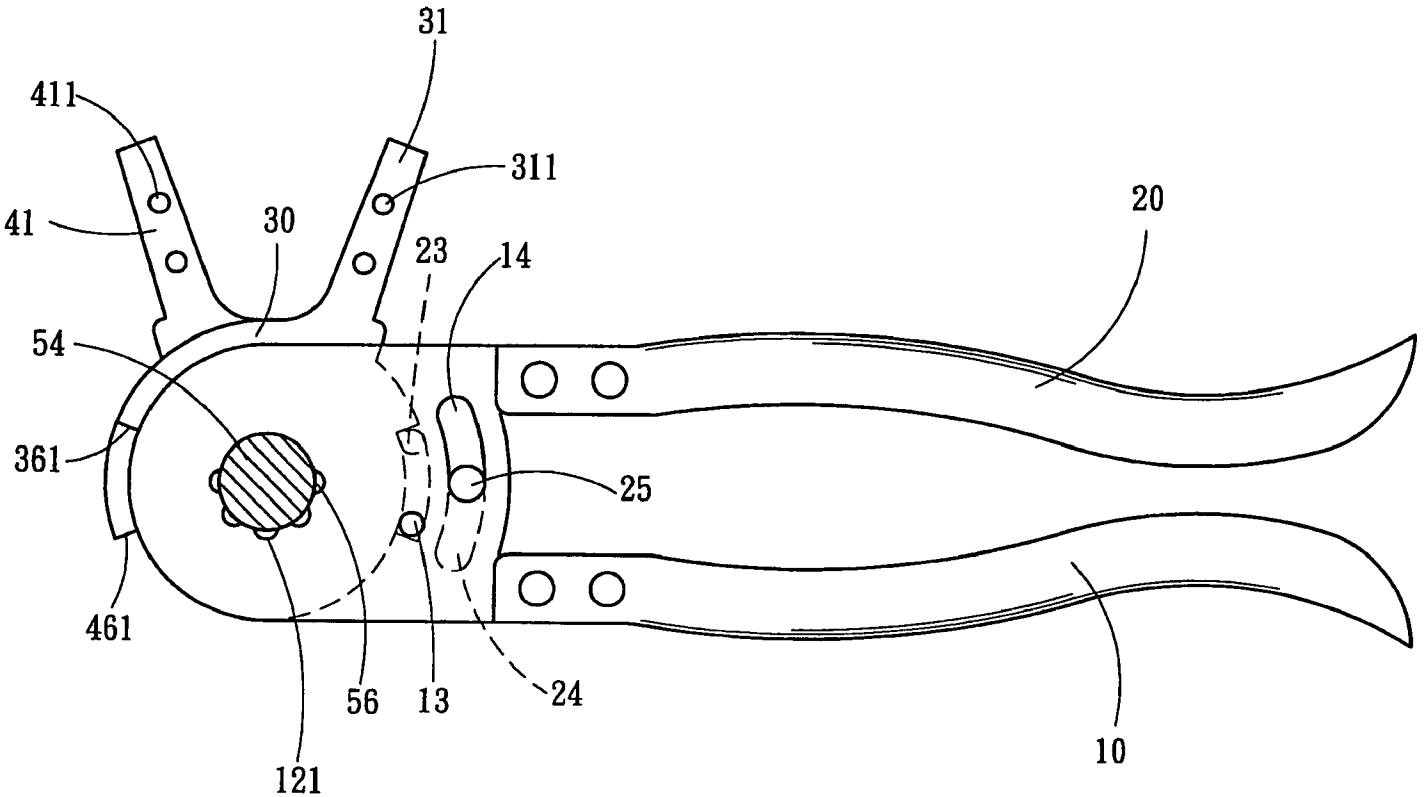
FIG. 5B is a plain view of the invention according to FIG. 5A with the left and right driving sections turning for 90 degrees.
Figure 5C:
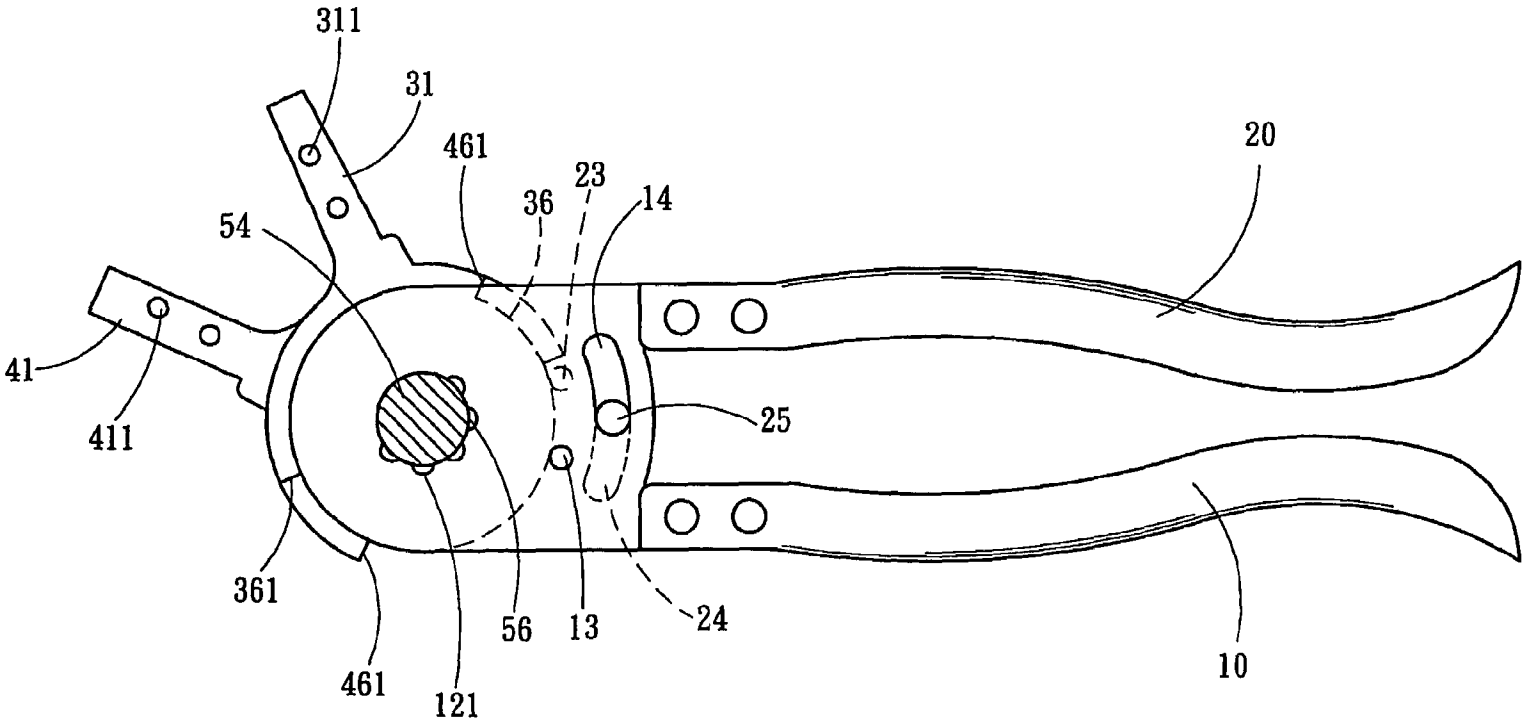
FIG. 5C is a plain view of the invention according to FIG. 5A with the left and right driving sections turning for 45 degrees.

When in use, in most cases the left and right driving sections 40 and 30 are located on the front ends of the left and right handles 10 and 20 as shown in FIG. 5A. In the event that there is a space constraint for wrenching operation, the angles of the left and right driving sections 40 and 30 may be altered. Referring to FIG. 4B, first, unfasten the third nut 53 on the upper side of the coupling element 50; then depress the bolt head 51 to separate the left and right handles 10 and 20 from the elastic anchor members 56 so that the left and right handles 10 and 20 may be turned in a biased manner for a selected angle; release the bolt head 51, the spring 52 pushes the coupling element 50 to its original position, and the two elastic anchor members 56 will be latched on other anchor notches 121 and 221; then fasten the third nut 53 to the actuating shaft 54 again to couple with the upper screw thread section 55. Thereby the left and right driving sections 40 and 30, and the left and right handles 10 and 20 may be coupled together at a biased angle (referring to FIGS. 5B and 5C) for wrenching the work pieces.

When the tool is in a clamping condition, the first anchor strut 13 on the lower side of the left handle 10 rams against the first bucking sections 361 on the left and right sides of the first swivel rim 36, while the second anchor strut 23 extended from the inner side wall of the right handle 20 rams against the second bucking sections 461 of the second swivel rim 46 to limit the opening angle of the left and right handles 10 and 20.

Figure 6A:
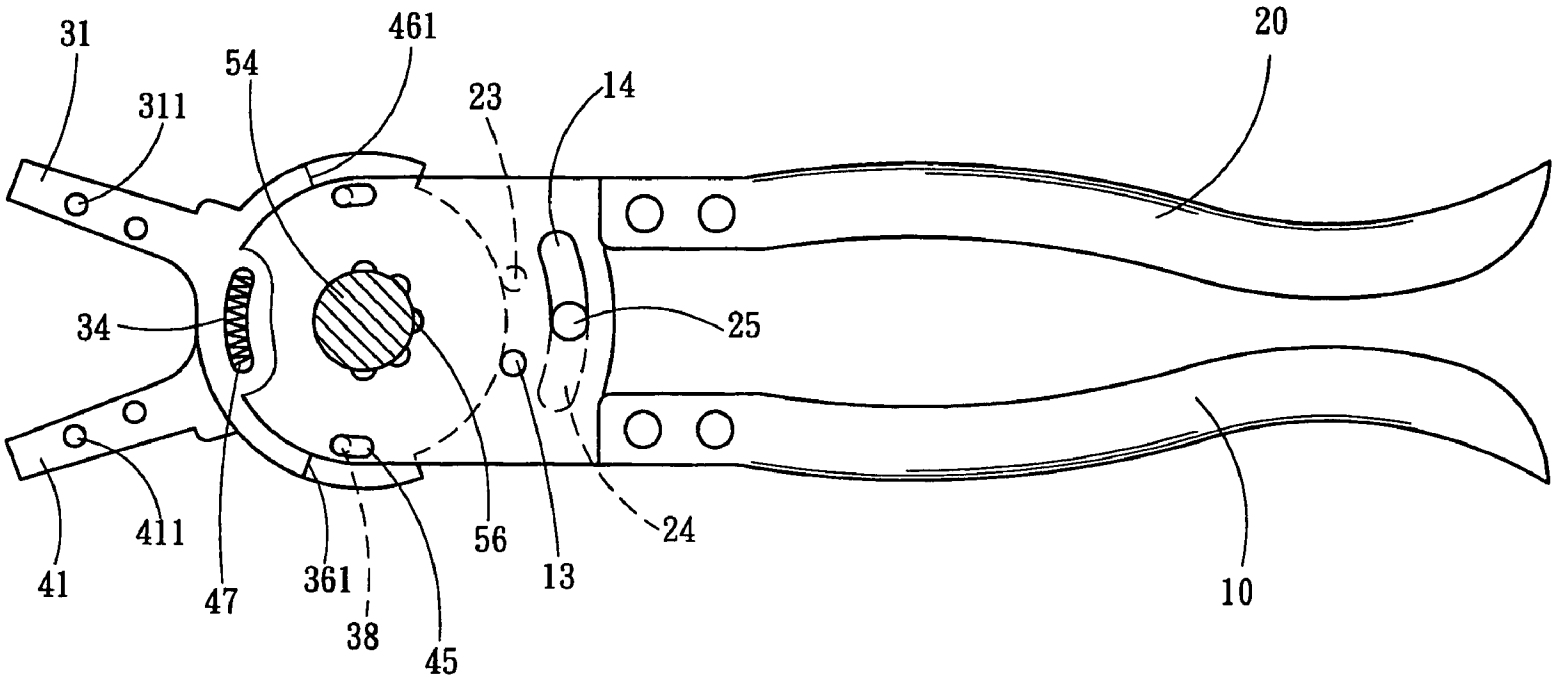
FIG. 6A is a plain view of the invention with the left and right driving sections in an open condition.
Figure 6B:
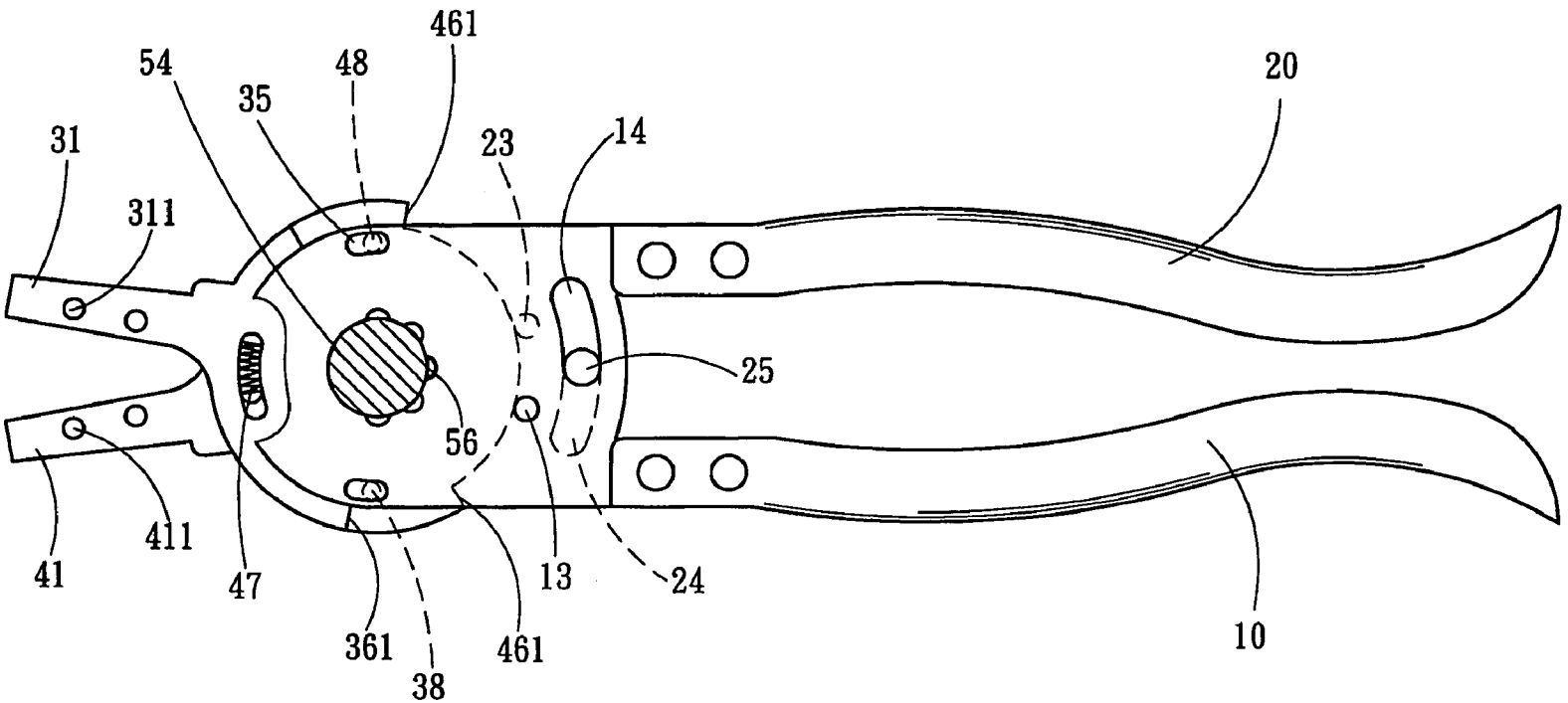
FIG. 6B is a plain view of the invention with the left and right driving sections in a closed condition.

Moreover, to maintain the left and right driving sections 40 and 30 in an open condition constantly to wrench and extend the C-shaped snap ring, referring to FIG. 6A, it may rely to the elastic element 47 housed in the first and second housing troughs 34 and 44 to provide an elastic force to push and move away the left and right driving sections 40 and 30. One the contrary, to the move the left and right jaws 414 and 314 on the front ends of the left and right driving sections 40 and 30 to couple with the two round holes of the C-shaped snap ring, referring to FIG. 6B, compress the left and right driving sections 40 and 30 to a clamp position desired.

By means of the construction set forth above, the invention provides a feature that allows the left and right driving sections 40 and 30 to alter angle so that the left and right handles 10 and 20 can drive the left and right driving sections 40 and 30 at a biased angle (such as 45 or 90 degrees) to wrench the work piece. Thereby it can clamp the C-shaped snap rings easily and make wrenching operation more convenient. The embodiment previously discussed is based on the left and right jaws 414 and 314 for assembling and disassembling the C-shaped snap ring as the work piece. Depending on different work pieces, different types of jaws may be selected to couple with the front ends of the left and right driving sections 40 and 30.

What is claimed is:

1. A tool equipped with a turnable driving head, comprising:

a left handle having a first plate on a front end, the first plate having a first bore which has a plurality of first anchor notches on the peripheral rim, a first anchor strut located on a lower side and an arched first retaining trough on a right side thereof;

a right handle pivotally coupled with the left handle in an opposing manner having a second plate on a front side, the second plate having a second bore which has a plurality of second anchor notches on the peripheral rim, a second anchor strut located on an upper side and an arched second retaining trough on a left side thereof;

a right driving section having a first coupling end on a front side and a round first pivot end on a rear side, the first pivot end having a first pivot hole in the center, an arched first housing trough on a left diagonal corner, an arched first slot on a upper right side, a concave first swivel rim on the rear side retracted inwards and two first bucking sections on two sides thereof to ram against the first anchor strut of the left handle;

a left driving section opposing the right driving section having a second coupling end on a front side and a round second pivot end on a rear side, the second pivot end having a second pivot hole in the center, an arched second housing trough on a right diagonal corner, an arched second slot on a upper left side, and a concave second swivel rim on the rear side retracted inwards; and a coupling element having a bolt head on one end and an actuating shaft on other end, the actuating shaft having respectively a screw thread section located on an upper end and a lower end, and two elastic anchor members located thereon to couple with the anchor notches of the left handle and the right handle, and running through a spring and a nut and the first bore and the second bore of the left and the right handles and the first pivot hole and the second pivot hole of the right and the left driving sections to couple with another nut.

2. The tool equipped with a turnable driving head of claim 1, wherein the arched first retaining trough and the arched second retaining trough are coupled through a pin.

3. The tool equipped with a turnable driving head of claim 1, wherein the first coupling end and the second coupling end have respectively two apertures to receive bolts to couple with nuts for fastening a pair of a right jaw and a left jaw.

4. The tool equipped with a turnable driving head of claim 1, wherein the first housing trough and the second housing trough of the right driving section and the left driving section jointly hold an elastic element.

5. The tool equipped with a turnable driving head of claim 4, wherein the elastic element is a spring.

* * * * *